US010494836B2

(12) United States Patent
Voelker

(10) Patent No.: US 10,494,836 B2
(45) Date of Patent: Dec. 3, 2019

(54) BORED LOCK OCCUPANCY INDICATOR

(71) Applicant: Sargent Manufacturing Company, New Haven, CT (US)

(72) Inventor: Christine Voelker, East Hampton, CT (US)

(73) Assignee: SARGENT MANUFACTURING COMPANY, New Haven, CT (US)

( * ) Notice: Subject to any disclaimer, the term of this patent is extended or adjusted under 35 U.S.C. 154(b) by 81 days.

(21) Appl. No.: 15/698,144

(22) Filed: Sep. 7, 2017

(65) Prior Publication Data

US 2018/0066450 A1 Mar. 8, 2018

Related U.S. Application Data

(60) Provisional application No. 62/384,570, filed on Sep. 7, 2016.

(51) Int. Cl.
*E05B 41/00* (2006.01)
*E05B 17/10* (2006.01)
(Continued)

(52) U.S. Cl.
CPC ..... *E05B 41/00* (2013.01); *E05B 13/106* (2013.01); *E05B 17/10* (2013.01); *E05B 39/00* (2013.01); *E05B 47/0001* (2013.01); *E05B 55/005* (2013.01); *E05B 47/0012* (2013.01); *E05B 65/0035* (2013.01); *E05B 2047/0058* (2013.01); *E05B 2047/0067* (2013.01)

(58) Field of Classification Search
CPC ..... E05B 17/10; E05B 17/106; E05B 39/00; E05B 41/00
See application file for complete search history.

(56) References Cited

U.S. PATENT DOCUMENTS 4,683,741 A * 8/1987 Fields ..... E05B 17/10 109/38
4,760,380 A * 7/1988 Quenneville ..... E05B 17/10 340/542

(Continued)

FOREIGN PATENT DOCUMENTS

CN 203081056 U 7/2013

*Primary Examiner* — Christopher J Boswell
(74) *Attorney, Agent, or Firm* — DeLio Peterson & Curcio LLC; Thomas E. Ciesco

(57) ABSTRACT

A lock for a door to a room comprising an interior handle disposed on an interior surface of the door, the interior handle having a lock control, the lock control operable between a first position and a second position and an exterior handle disposed on an exterior surface of the door. The lock includes a visual lock indicator on a portion of the interior or exterior handle. The lock control is operable between a first position and a second position. The lock includes a lock body disposed between the interior handle and the exterior handle, the lock body operable by the lock control from the first position wherein the exterior handle allows the door to open to the second position wherein the exterior door handle is prevented from opening the door. The visual lock indicator is in an off condition when the lock control is in the first position and the visual lock indicator is in an on condition when the lock control in the second position, the visual lock indicator indicating that the room is occupied and secured.

20 Claims, 9 Drawing Sheets

(51) Int. Cl.

| | |
|---|---|
| ***E05B 39/00*** | (2006.01) |
| ***E05B 13/10*** | (2006.01) |
| ***E05B 47/00*** | (2006.01) |
| ***E05B 55/00*** | (2006.01) |
| *E05B 65/00* | (2006.01) |

(56) References Cited

U.S. PATENT DOCUMENTS

| | | | | |
|---|---|---|---|---|
| 5,372,025 | A | 12/1994 | Lin | |
| 6,107,934 | A | 8/2000 | Andreou | |
| 6,622,537 | B2 * | 9/2003 | Rodriguez | E05B 17/10 362/100 |
| 7,172,306 | B1 * | 2/2007 | Campa | E05B 17/10 362/100 |
| 7,248,163 | B2 * | 7/2007 | Wu | E05B 41/00 200/61.64 |
| 9,024,759 | B2 * | 5/2015 | Uyeda | E05B 47/00 340/542 |
| 9,562,370 | B2 * | 2/2017 | Ohl | E05B 47/068 |
| 9,758,990 | B2 * | 9/2017 | Beck | E05B 41/00 |
| 10,167,654 | B2 * | 1/2019 | Mahoney | E05B 17/10 |
| 2014/0311197 | A1 | 10/2014 | Abel | |
| 2015/0315816 | A1 | 5/2015 | Gopalakrishnan | |
| 2015/0218850 | A1 | 8/2015 | Uyeda | |
| 2017/0236389 | A1 * | 8/2017 | Tang | B60Q 1/323 49/13 |

* cited by examiner

BORED LOCK OCCUPANCY INDICATOR

BACKGROUND OF THE INVENTION

1. Field of the Invention

The present invention relates to a door lock having a visual status indicator is described and, more particularly, a bored lock for a door providing access to a room wherein occupancy of the room is identified by a visual indicator which may be a light, such as an LED, or some other type of visual indicator.

2. Description of Related Art

A door lock generally includes a lock and an inner handle operator and an outer operator which operate the mortise lock. The door lock usually includes a latching mechanism including a latch bolt which secures the door to the doorframe when the door is closed, as well as a locking mechanism which prevents the latching mechanism from being retracted when the door is locked. The handle operators are generally surface mounted on opposite sides of the door and operate the latching mechanism. When the door lock mechanism is not locked, rotation of the handle operators will retract the latch bolt and allow the door to be opened. Locking the door lock will normally block rotation of one or both of the handle operators.

Determining the particular status of the door lock solely by a visual inspection of the lock itself is difficult. A visual dedicated indicator, separate from the door lock, is often provided on the outside of a door to let the person on the outside of the door know if the door is locked and the room occupied. One example is a door of a public toilet wherein the door lock has an "occupied/vacant" indicator which is operated from the inside of the door and upon locking of the door. Visual indicators are also employed in hotel rooms.

For the foregoing reasons, there is a need for an improved visual indicator mounted on the outside of the door and in communication with the door lock to indicate whether the door is locked or unlocked without the need to physically engage the handle operator. The visual indicator is activated when the lock mechanism is in the locked position. Alternately, a visual indicator disposed on the inside portion of the door lock can be used by occupants in the interior of the room or other space to confirm if the lock mechanism is in the locked or unlocked position, thereby allowing the occupants to know if the door is secure or not secure.

SUMMARY OF THE INVENTION

Bearing in mind the problems and deficiencies of the prior art, it is therefore an object of the present invention to provide an occupancy indicator which provides an alert that a room is occupied or locked.

It is another object of the present invention to provide a visual indication of a door being locked.

A further object of the invention is to provide an illuminated indicator on the outside of a door being locked.

It is yet another object of the present invention to provide a bored or other lock which includes two states that may alert a person from a distance that a room is occupied and secured.

A still further object of the invention is to provide an illuminated indicator on the inside of a door being locked.

Still other objects and advantages of the invention will in part be obvious and will in part be apparent from the specification.

The above and other objects, which will be apparent to those skilled in the art, are achieved in the present invention which is directed to a lock for a door to a room comprising an interior handle disposed on an interior surface of the door the interior handle having a lock control, the lock control operable between a first position and a second position and an exterior handle disposed on an exterior surface of the door. The lock includes a visual lock indicator on a portion of the interior or exterior handle and a lock body disposed between the interior handle and the exterior handle, the lock body operable by the lock control from the first position wherein the exterior handle allows the door to open to the second position wherein the exterior door handle is prevented from opening the door. The visual lock indicator is in an off condition when the lock control is in the first position and the visual lock indicator is in an on condition when the lock control in the second position, the visual lock indicator indicating that the room is occupied and secured. The exterior handle may include a recess or a projection for unlocking the door lock. The visual lock indicator may be on disposed the exterior or interior handle. The visual lock indicator may include a lock barrel having a cylindrical body, the lock barrel disposed in the lock body, a power source disposed in the lock barrel cavity, the power source for providing electrical power to the visual lock indicator and an actuator disposed between the power source and the visual lock indicator, the actuator in communication with the lock control. The lock control in the first position may place the actuator in the first actuator position, preventing electrical current from flowing from the power source to the visual lock indicator and the lock control in the second position may place the actuator in the second actuator position preventing electrical current from flowing from the power source to the visual lock indicator. The lock barrel may be conductive and may include a cavity in an interior portion thereof and a protrusion inside the cavity extending inwardly from the lock barrel, wherein the actuator provides an electrical connection to the lock barrel protrusion when the lock control is in the second position. The visual lock indicator may be in communication with an electronic device for monitoring the visual lock indicator. The lock control may be in communication with an electronic device for controlling the lock control. The visual lock indicator may be viewable through an opening in the lever. The visual lock indicator may provide different colors, different numbers, different letters, and/or different shapes to indicate occupancy of a room and may comprise a light or LED light. The visual lock indicator may be operated by a key operated mechanism. The visual lock indicator may be disposed in a cap on the exterior handle and further include an electrically conductive lock barrel having a cylindrical body, a cavity in an interior portion of the cylindrical body and a protrusion inside the cavity extending inwardly from the cylindrical body. The visual lock indicator may include a circuit board having an occupancy indicator, the circuit board disposed at a first end of the lock barrel and including a first and second power input terminal, the occupancy indictor providing a visual signal when power is applied to the first and second circuit board terminal. The visual lock indicator may include a power source disposed in the lock barrel cavity, the power source having a first and second terminal for providing electrical power to the circuit board, the power source second terminal in electrical communication with the circuit board second terminal. The visual lock indicator may include an insulator disposed at a second end of the lock barrel opposite the first end, the insulator having a flat inside surface and an outside surface including at least one tab extending therefrom. The visual lock indicator may include an actuator disposed against the inside surface of the insulator, the actuator in communication with a first terminal of the power source and moveable from a first position allowing electrical current to flow from the first terminal of the power source to the conductive lock barrel to a second position which prevents electrical current from flowing from the first terminal of the power source to the conductive lock barrel. The visual lock indicator may include a lock tail secured to the at least one tab of the insulator, the lock tail extending outwardly from the insulator in a direction opposite the first end of the lock barrel, the lock tail extending from the outer lock opening to the inner lock opening in communication with the lock control. The lock control in the locked position may place the actuator in the first actuator position allowing electrical current to flow from the first terminal of the power source through the lock barrel and to the first terminal of the circuit board and the lock control in the unlocked position may place the actuator in the second actuator position preventing electrical current from flowing though the lock barrel and into the first terminal of the circuit board.

Another aspect of the invention is directed to a lock for a door comprising an inner door handle including an inner lock opening extending to a door latch, an outer door handle including an outer lock opening extending to the inner lock opening and a lock control disposed in the inner lock opening, the lock control movable from a locked position wherein the door latch is prevented from being moved by the outer door handle to an unlocked position wherein then door latch may be retracted by movement of the outer door handle. The lock includes a visual lock indicator disposed in the inner or outer lock opening, the visual lock indicator in communication with the locking control. The visual lock indicator includes an electrically conductive lock barrel having a cylindrical body, a cavity in an interior portion of the cylindrical body and a protrusion inside the cavity extending inwardly from the cylindrical body and a circuit board having an occupancy indicator disposed in a cap on the outer door handle, the circuit board disposed at a first end of the lock barrel and including a first and second power input terminal, the occupancy indicator providing a visual signal when power is applied to the first and second circuit board terminal. The visual lock indicator includes a power source disposed in the lock barrel cavity, the power source having a first and second terminal for providing electrical power to the circuit board, the power source second terminal in electrical communication with the circuit board second terminal and an insulator disposed at a second end of the lock barrel opposite the first end, the insulator having a flat inside surface and an outside surface including at least one tab extending therefrom. The visual lock indicator includes an actuator disposed against the inside surface of the insulator, the actuator in communication with a first terminal of the power source and moveable from a first position allowing electrical current to flow from the first terminal of the power source to the conductive lock barrel to a second position which prevents electrical current from flowing from the first terminal of the power source to the conductive lock barrel. The visual lock indicator includes a lock tail secured to the at least one tab of the insulator, the lock tail extending outwardly from the insulator in a direction opposite the first end of the lock barrel, the lock tail extending from the outer lock opening to the inner lock opening in communication with the lock control. The lock control in the locked position places the actuator in the first actuator position allowing electrical current to flow from the first terminal of the power source through the lock barrel and to the first terminal of the circuit board and the lock control in the unlocked position places the actuator in the second actuator position preventing electrical current from flowing though the lock barrel and into the first terminal of the circuit board.

Another aspect of the invention is directed to a visual lock indicator comprising an electrically conductive cylindrical lock barrel having a cavity and a circuit board having an occupancy indicator disposed in a cap, the circuit board disposed at a first end of the lock barrel and including a first and second power input terminal, the occupancy indictor providing a visual signal when power is applied to the first and second circuit board terminal. The visual lock indicator includes a power source disposed in the lock barrel cavity, the power source having a first and second terminal for providing electrical power to the circuit board, the power source second terminal in electrical communication with the circuit board second terminal and an insulator disposed at a second end of the lock barrel opposite the first end, the insulator having a flat inside surface and an outside surface including at least one tab extending therefrom. The visual lock indicator includes an actuator disposed against the inside surface of the insulator wherein in a first position the actuator provides an electrical connection from the power source to the circuit board and in a second position the actuator prevents electrical current from flowing from the power source to the circuit board and a lock tail secured to the at least one tab of the insulator, the lock tail extending outwardly from the insulator in a direction opposite the first end of the lock barrel, the lock tail extending from the outer lock opening to the inner lock opening in communication with the lock control. The lock control in the locked position places the actuator in the first actuator position allowing electrical current to flow from the first terminal of the power source through the lock barrel and to the first terminal of the circuit board and the lock control in the unlocked position places the actuator in the second actuator position preventing electrical current from flowing though the lock barrel and into the first terminal of the circuit board. The visual lock indicator is disposable in a lock opening, and is operated by a lock control to indicate that the lock is secured.

Another aspect of the invention is directed to a method of using a visual lock indicator comprising providing a door lock disposed on a door to a room, the door lock having an interior handle, an exterior handle, a lock control on a portion of the interior door handle and the visual lock indicator on a portion of the interior or exterior door portion. The method includes entering the room and closing the door while inside the room and operating the lock control to a first position to activate the door lock. The method includes securing the exterior handle in the locked position, the lock control first position further activating the visual lock indicator to indicate that the room is occupied and secured and upon desire to deactivate the visual lock indicator, operating the lock control to a second position to deactivate the visual lock indicator and allow movement of the interior door handle to open the door. The visual lock indicator may comprise an electrically conductive lock barrel having a cylindrical body, a cavity in an interior portion of the cylindrical body and a protrusion inside the cavity extending inwardly from the cylindrical body. The visual lock indicator may include a circuit board having an occupancy indicator disposed in a cap, the circuit board disposed at a first end of the lock barrel and including a first and second power input terminal, the occupancy indicator providing a visual signal when power is applied to the first and second circuit board terminal. The visual lock indicator may include a power source disposed in the lock barrel cavity, the power source having a first and second terminal for providing electrical power to the circuit board, the power source second terminal in electrical communication with the circuit board second terminal and an insulator disposed at a second end of the lock barrel opposite the first end, the insulator having a flat inside surface and an outside surface including at least one tab extending therefrom. The visual lock indicator may include an actuator disposed against the inside surface of the insulator, the actuator in communication with a first terminal of the power source and moveable from a first position allowing electrical current to flow from the first terminal of the power source to the conductive lock barrel to a second position which prevents electrical current from flowing from the first terminal of the power source to the conductive lock barrel. The visual lock indicator may include a lock tail secured to the at least one tab of the insulator, the lock tail extending outwardly from the insulator in a direction opposite the first end of the lock barrel, the lock tail extending from the outer lock opening to the inner lock opening in communication with the lock control. The lock control in the locked position may place the actuator in the first actuator position allowing electrical current to flow from the first terminal of the power source through the lock barrel and to the first terminal of the circuit board and the lock control in the unlocked position may place the actuator in the second actuator position preventing electrical current from flowing though the lock barrel and into the first terminal of the circuit board. The visual lock indicator may be on the exterior or interior handle.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-19 of the drawings in which like numerals refer to like features of the invention.

While an example embodiment of the occupancy indicator is shown and described as a typical application of the device, it is to be understood that the lock occupancy indicator is applicable to any buildings, structures, vehicles, or vessels (such as ships) containing one or more separate rooms. The term "outside" is generally used to refer to the side of the door or lock outside of the room and the term "inside" is generally used to refer to the side of the door or lock facing the interior of the room, unless otherwise stated.

Figure 1A:
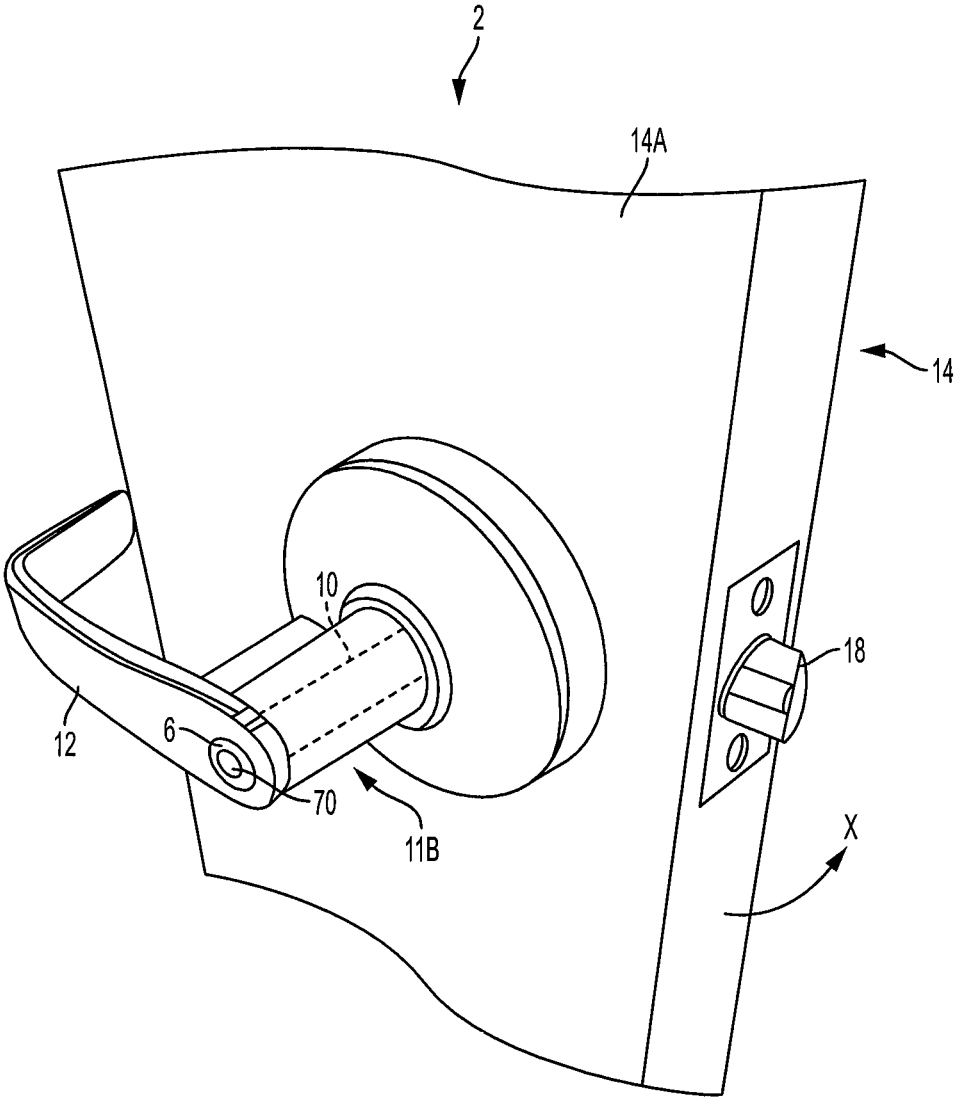
FIG. 1A is a perspective view of the exterior side of a door having a visual lock indicator with the occupancy indicator on the exterior handle according to the present invention.
Figure 1B:
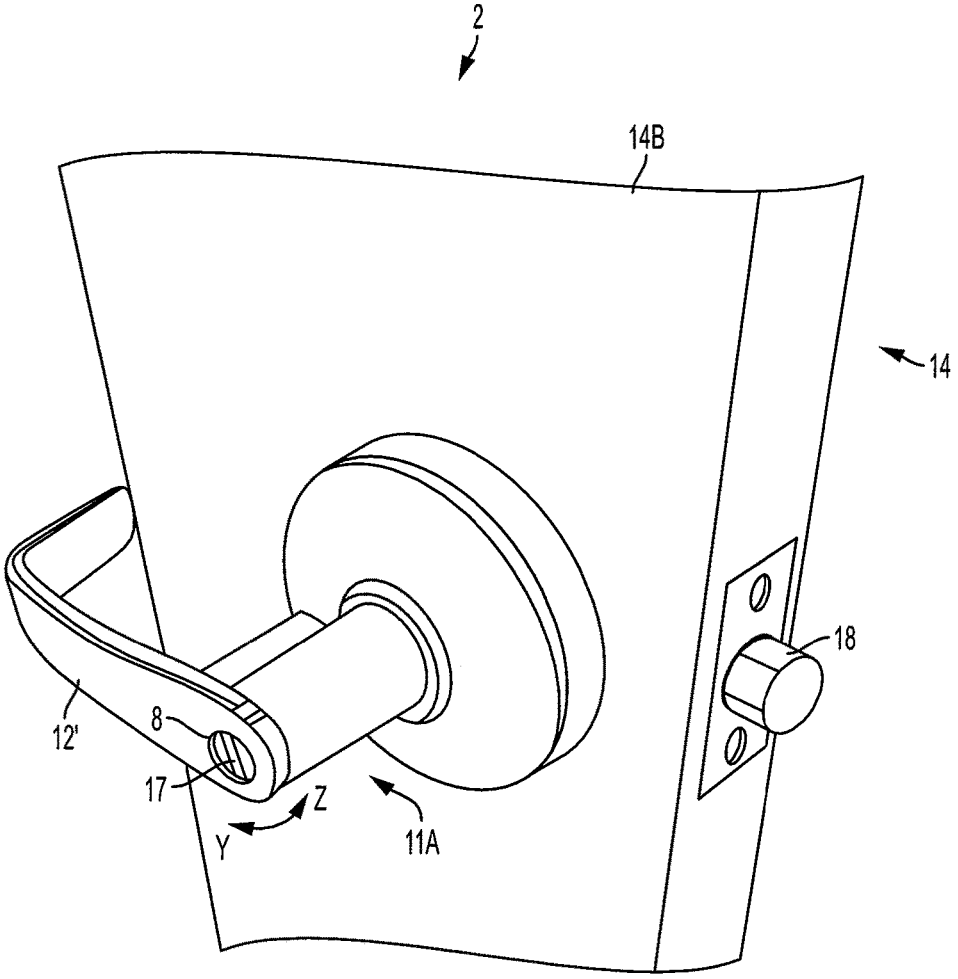
FIG. 1B is a perspective view of the interior side of a door having a visual lock indicator with the occupancy indicator on the exterior handle.

In one embodiment of the bored lock occupancy indicator 2, FIGS. 1A and 1B show a door 14 having an exterior surface 14A and an exterior surface 14B. The door may include an exterior handle 12 and an interior handle 12' which operate the latch 18. A lock control 17 is disposed on the interior or inside handle 12' and a visual lock indicator 10 having an occupancy indicator 70 is located on the exterior or outside handle 12. A passerby thus may observe if the lock is in the secured or unsecured position and if the room is occupied.

Figure 1C:
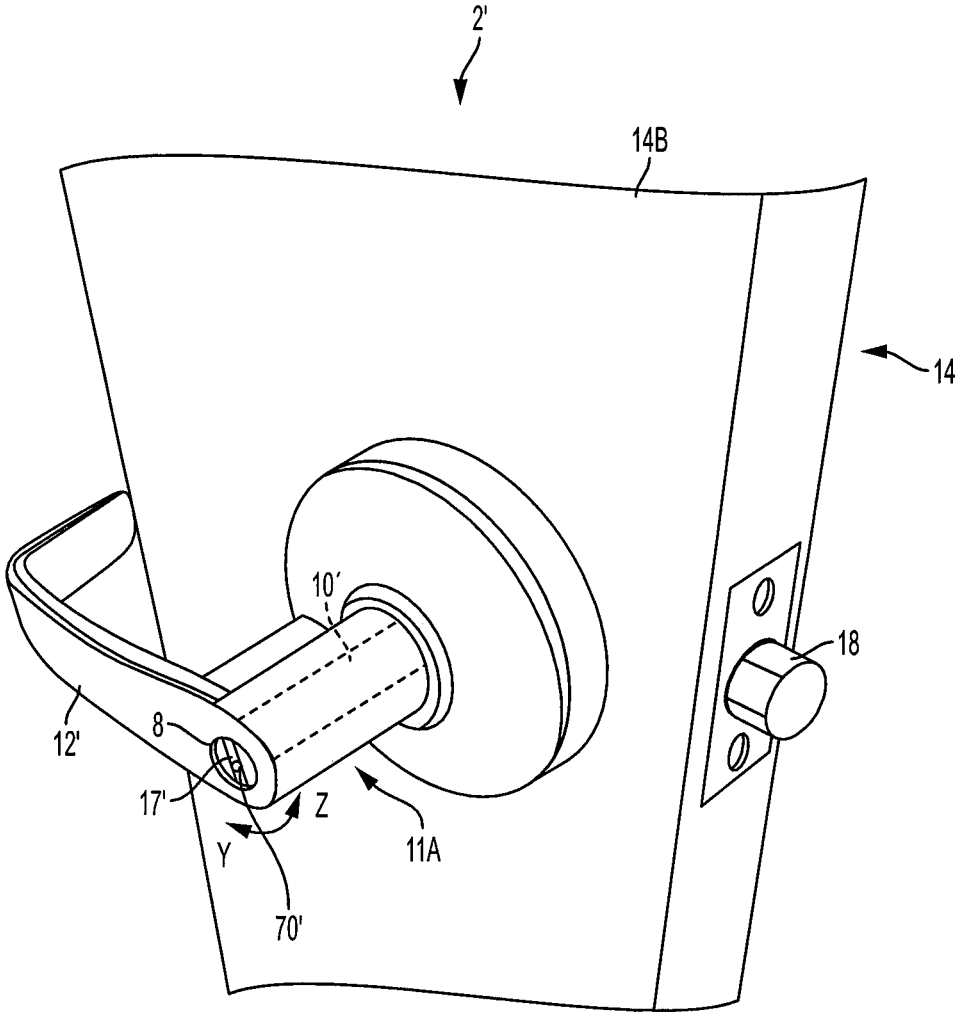
FIG. 1C is a perspective view of the interior side of a door having the visual lock indicator with the occupancy indicator on the interior handle.
Figure 2:
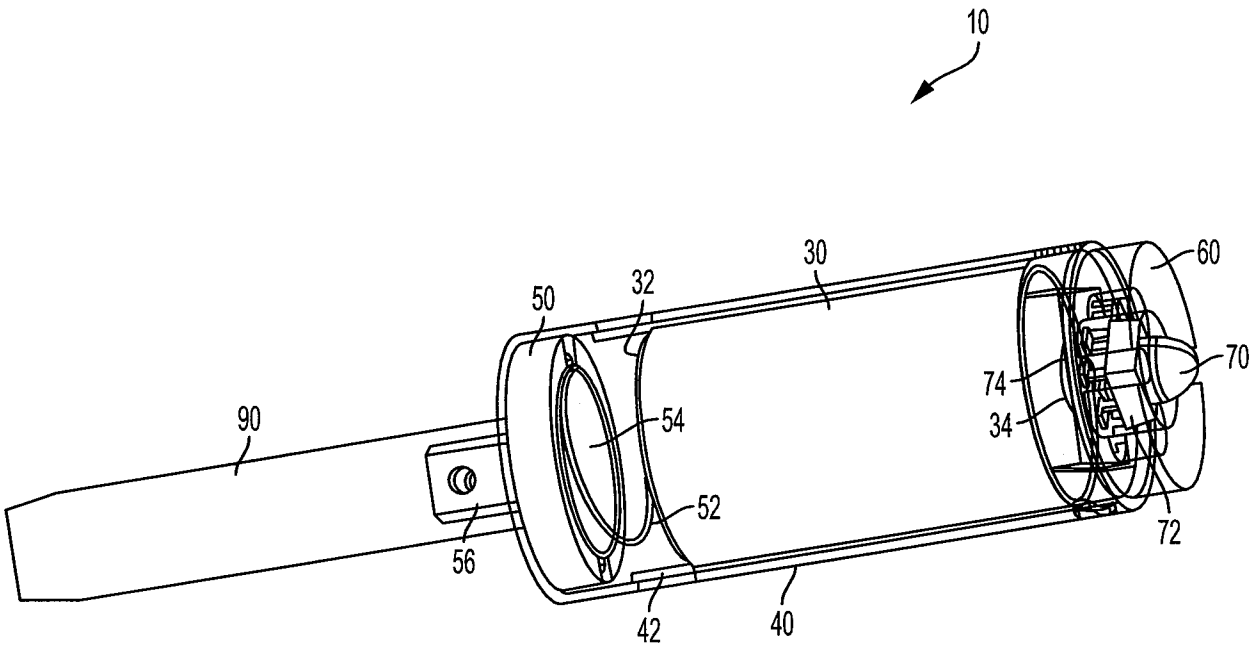
FIG. 2 is a perspective phantom view of a visual lock indicator according to the present invention.
Figure 3:
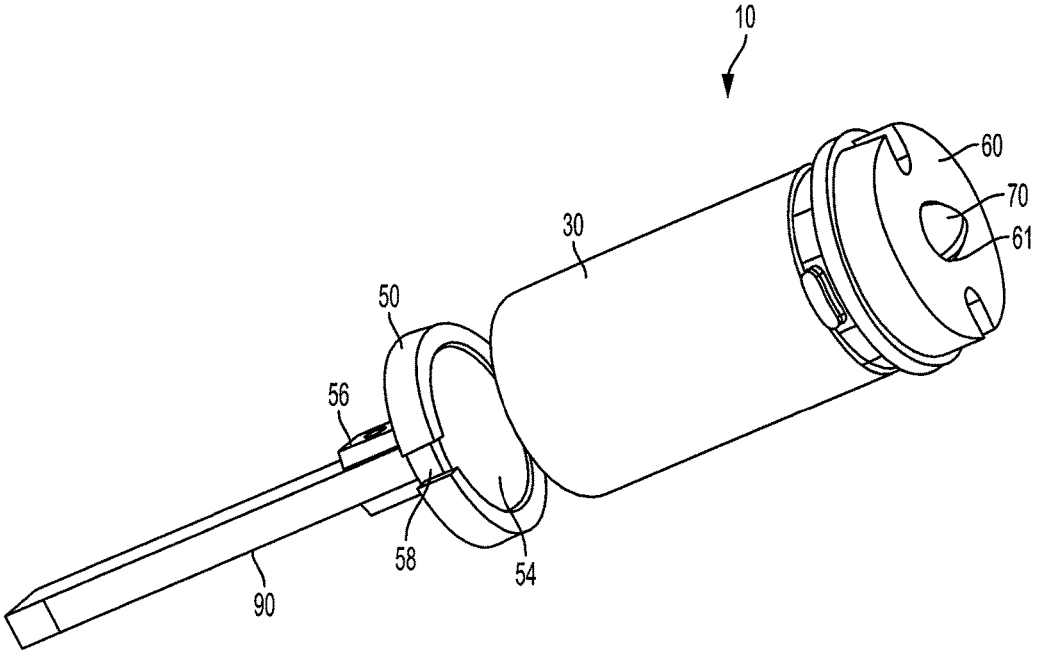
FIG. 3 is a perspective view of the visual lock indicator shown in FIG. 2 with the cylindrical barrel and spring remove.
Figure 4:
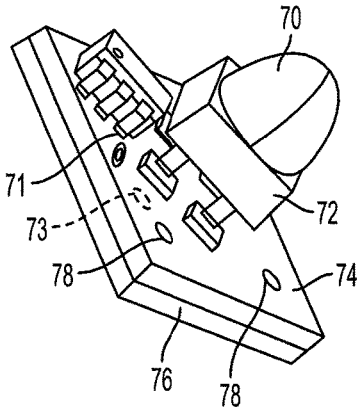
FIG. 4 is a perspective view of the insulator shown in FIG. 2.
Figure 5:
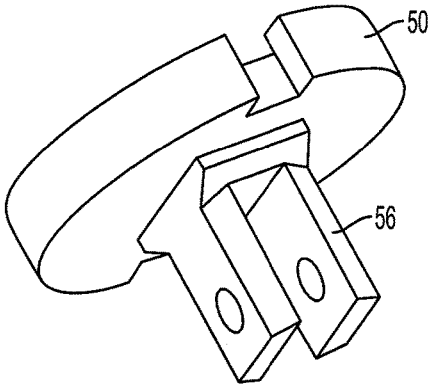
FIG. 5 is a perspective view of the upper circuit board and indicator light shown in FIG. 2.

In an alternate embodiment of the bored lock occupancy indicator 2' as shown in FIG. 1C, the door lock includes a visual lock indicator 10' with the occupancy indicator 70' integrated with the lock control 17' disposed on the interior handle so the occupant may observe if the lock is in the secured or unsecured position.

One embodiment of the visual lock indicator 10 includes a lock for a door 14 comprising the inner door handle 12' having an inner lock opening 8 extending to a door latch 18 and an outer door handle 12 including an outer lock opening 6 extending to the inner lock opening 8. The lock comprises a lock body 11A, 11 B, the lock body including the visual lock indicator 10 and a lock control 17. The lock control 17 is disposed in the inner lock opening 8 wherein the lock control 17 is movable from a locked position wherein the door latch 18 is prevented from being moved by the outer door handle 12 to an unlocked position wherein then door latch 18 may be retracted by movement of the outer door handle 12. The door lock includes a visual lock indicator 10 disposed in the outer lock opening 6, the visual lock indicator 10 in communication with the lock control 17. As shown in the cutaway view of FIG. 2 and the perspective view (with the cylindrical barrel removed for clarity) of FIG. 3, the lock occupancy indicator 10 has an electrically conductive cylindrical lock barrel 40 having a cavity and a circuit board 74 having an occupancy indicator disposed in an opening 61 of a cap 60. The circuit board 74 is disposed adjacent the interior surface of the the cap 60 at a first end of the lock barrel 30 and includes a first power input terminal 71 and a second power input terminal 73 preferably on the bottom portion of the circuit board 74, the occupancy indicator 70 providing a visual signal when power is applied to the first circuit board terminal 71 and a second circuit board terminal 73. The occupancy indicator 70 may be a lamp supported on a lamp base 72. The visual lock indicator 10 has a power source 30 disposed in the lock barrel cavity 41, the power source 30 preferably being a battery or a coin cell battery including a first power terminal 32 and a second power terminal 34 for providing electrical power to the circuit board 74, the power source second terminal 34 in electrical communication with the circuit board second terminal 73. The visual lock indicator 10 has a cap 60 disposed on one side of the cylindrical lock barrel 40 and the occupancy and an insulator 50 disposed at a second end of the lock barrel 40 opposite the first end, the insulator having a flat inside surface and an outside surface including at least one insulator tab 56 extending therefrom. The visual lock indicator 10 has an actuator 54 disposed against the inside surface of the insulator 50 wherein in a first actuator position the actuator 54 provides an electrical connection from the power source 30 to the circuit board 74 and in a second position the actuator 54 prevents electrical current from flowing from the power source 30 to the circuit board 74. A conductive spring 52 provides a permanent electrical connection between the power source first terminal 32 and the actuator 54 as well as providing a force to the power source 30 to maintain the power source second terminal in electrical contact with the circuit board second terminal 73. The actuator 54 is moveable from a first position allowing electrical current to flow from the first terminal 32 of the power source 30 to the conductive lock barrel 40 to a second position which prevents electrical current from flowing from the first terminal 32 of the power source 30 to the conductive lock barrel 40. The visual lock indicator 10 includes a lock tail 90 secured to the tab 56 of the insulator 50. The lock tail 90 extends outwardly from the insulator 50 in a direction opposite the first end of the lock barrel 40, the lock tail 40 extending from the outer lock opening to the inner lock opening and in communication with the lock control 17. The lock control 17 in the locked position places the actuator 54 in the first actuator position allowing electrical current to flow from the first terminal 32 of the power source 30 through the lock barrel 40 and to the first terminal 71 of the circuit board 74 and the lock control 17 in the unlocked position places the actuator 54 in the second actuator position preventing electrical current from flowing though the lock barrel 40 and into the first terminal of the circuit board 71.

As shown in FIGS. 6-19, the actuator 54 includes actuator tabs 58 which contact the barrel protrusions 42 when the lock control 17 is in the first position, allowing electrical current to flow from the power source 30, through the spring 52 to the actuator 54, from the actuator tabs 58 to the lock barrel protrusions 42 and then from the lock barrel to the circuit board, thus providing power to the occupancy indicator 70. When the lock control 17 is in the second position, the actuator tabs 58 are separated from the lock barrel tabs 42 and the electrical circuit is broken, preventing circuit board from being powered.

Figure 17:
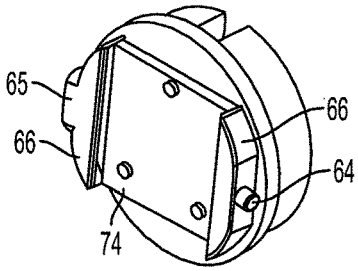
FIG. 17 is a perspective view of the keycap and upper circuit board shown in FIG. 2.
Figure 18:
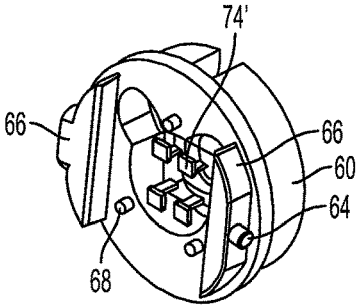
FIG. 18 is a perspective view of the keycap and portion of the upper circuit board shown in FIG. 2.
Figure 19:
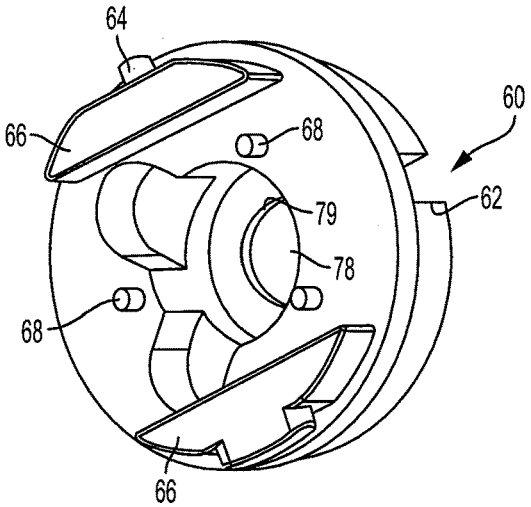
FIG. 19 is a perspective view of the keycap shown in FIG. 2.

The visual lock indicator 2 may include upper circuit board 74 and lower circuit board 76 secured to the cap 60 with cap projections 68 engagable with circuit board openings 78. The upper circuit board 74 includes the occupancy indicator 70 and the lower circuit board 76 includes second terminal 73. The upper circuit board 74 and lower circuit board 76 are in electrical communication with one another. In progression, FIG. 16 includes upper circuit board 74 and lower circuit board 76, FIG. 17 shows only upper circuit board 74 and FIG. 18 has both upper circuit board 74 and lower circuit board 76 removed to highlight the lamp base 72 which supports the occupancy indicator 70. Support members 66 align upper circuit board 74 and lower circuit board 76 as well as align the cap 60 in the end of lock barrel 40.

Figure 6:
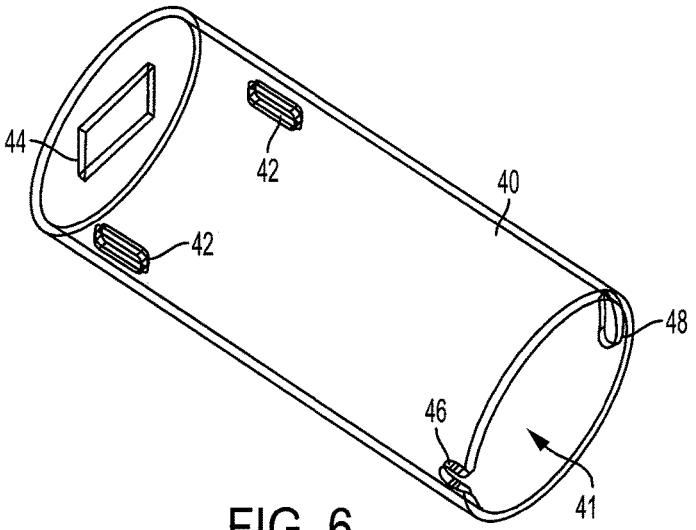
FIG. 6 is a perspective phantom view of the cylindrical barrel shown in FIG. 2.
Figure 7:
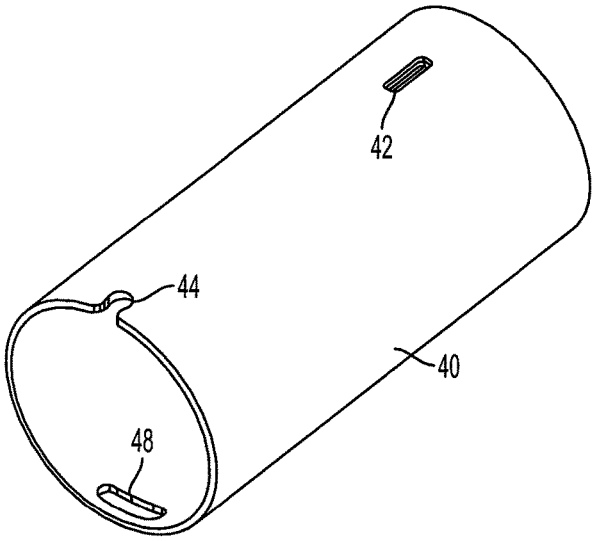
FIG. 7 is a perspective view of the cylindrical barrel shown in FIG. 2.
Figure 8:
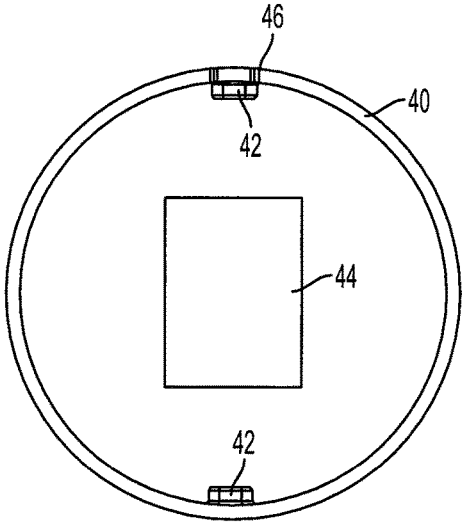
FIG. 8 is a rear elevational view of the cylindrical barrel shown in FIG. 2.
Figure 9:
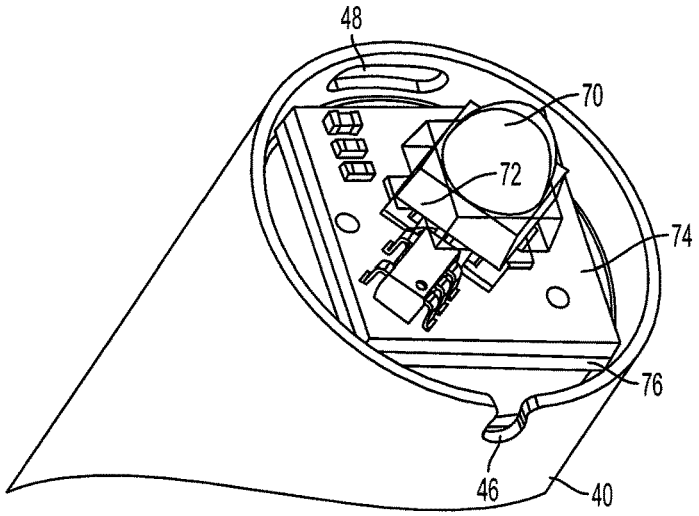
FIG. 9 is a perspective view of the cylindrical barrel, visual indicator, and upper and lower circuit board shown in FIG. 2.
Figure 10:
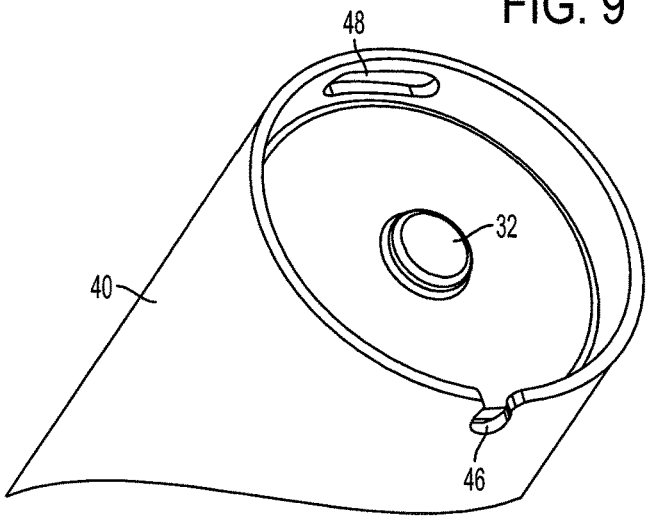
FIG. 10 is a perspective view of the cylindrical barrel and battery shown in FIG. 2.
Figure 11:
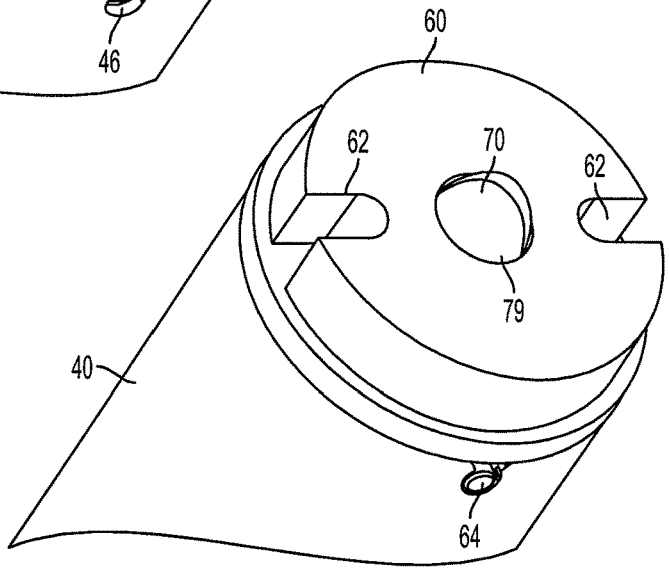
FIG. 11 is a perspective view of the cylindrical barrel, keycap and visual indicator shown in FIG. 2.
Figure 12:
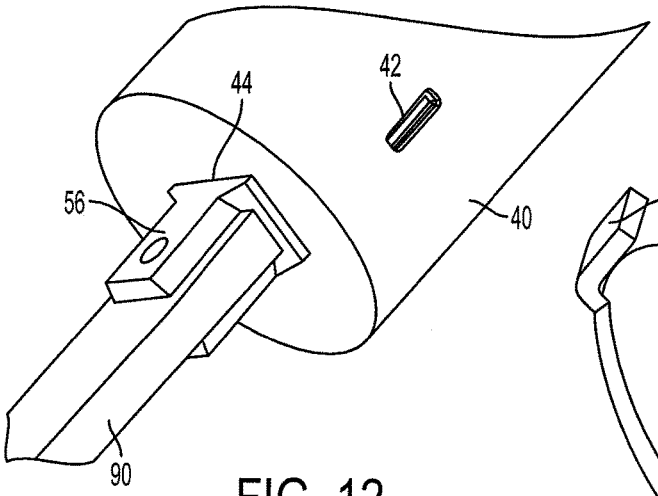
FIG. 12 is a perspective view of the cylindrical barrel and portions of the insulator and lock tail shown in FIG. 2.
Figure 14:
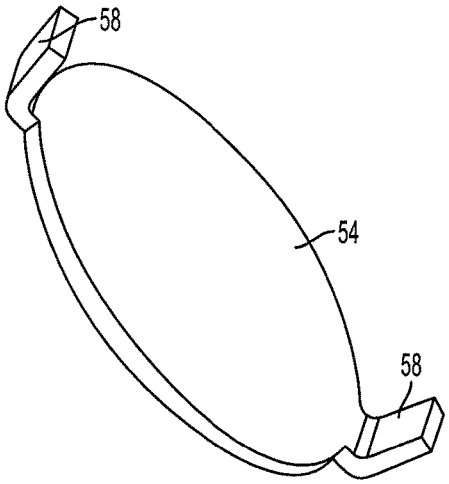
FIG. 14 is a perspective view of the actuator shown in FIG. 2.
Figure 13:
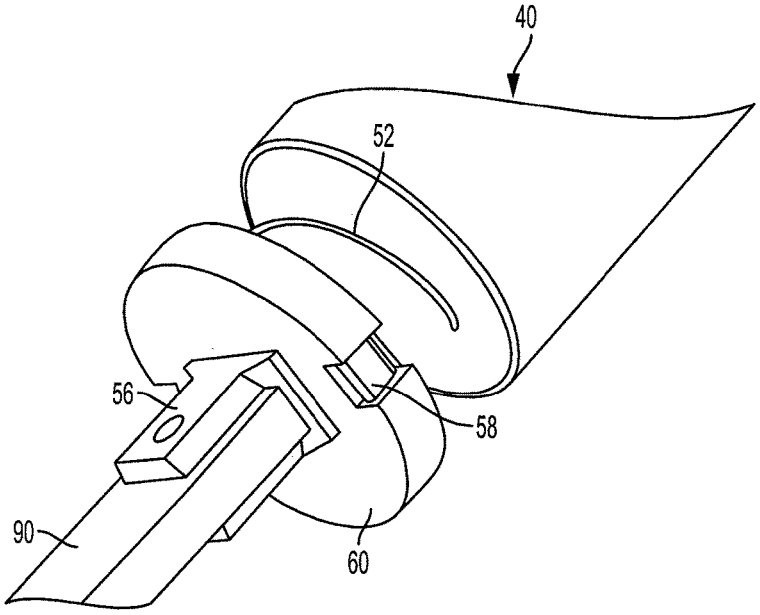
FIG. 13 is a partially exploded perspective view of the visual lock indicator according to the present invention.
Figure 15:
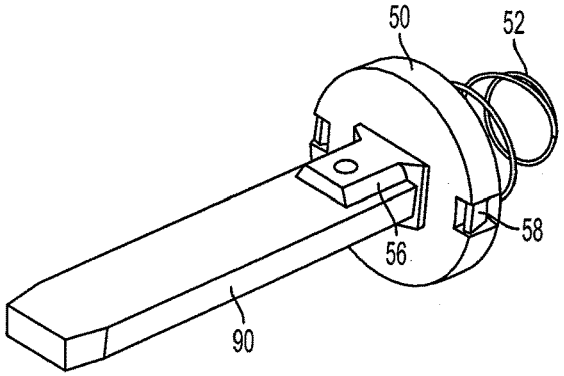
FIG. 15 is a perspective view of the insulator, spring, actuator and lock tail shown in FIG. 2.
Figure 16:
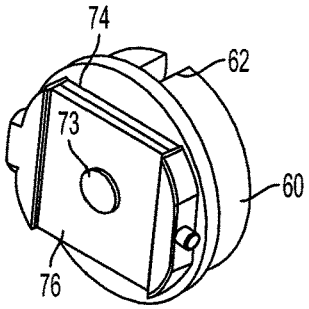
FIG. 16 is a perspective view of the keycap and upper and lower circuit board shown in FIG. 2.

An elevational view and perspective views of the lock barrel are shown in FIGS. 6-8 of the drawings. Cap protrusion 65 engages a barrel opening 48 for securing one portion of the cap 60 to the barrel 40 and cap protrusion 64 then snaps in barrel slot 45 securing the remaining portion of the cap 60 to the barrel 40. As shown in FIG. 15, insulator tabs 56 secure the lock tail 90 to the insulator 50, allowing the lock control 17 which engages the lock tail to rotate the insulator 50 and in turn rotating the actuator tabs 58 to engage the lock barrel protrusions 42 in one direction and disengage the lock barrel protrusions 42 in the opposite direction.

The visual indicator 10 and the inner latch operator handle may be combined in a single housing to make the lock easier to install and enhance its tamper resistance. In the embodiment where the visual indicator 10 is on the outside of the lock, the indicator may be used by occupants in the interior of the room or other space to confirm to those outside the room if the lock mechanism of the door lock 11A, 11B is in the locked or unlocked position. This allows passersby to know if the occupants in the room are secure or not secure. In the embodiment where the visual indicator is on the inside of the lock, the indicator may be used by the occupants of the room to confirm to them if the lock is in the locked or unlocked position.

In the embodiment shown in the drawings, the visual lock indicator 10 is a battery powered device. However, the visual lock indicator 10 may be powered by an external source or other power source without departing from the scope of the visual lock indicator. The visual indicator 10 may include an occupancy indicator 70 which is an illuminable lamp, such as but not limited to, an LED and extending through the opening 6 or opening 8 in the latch operator 12, 12' of the door lock 11A, 11B. Although lock 11 is depicted as a bored, tubular or cylindrical lock, any other type of lock may be used with the visual indicator described herein. These configurations allow a passerby outside the room or alternately an operator inside the room to view the occupancy indicator 10 to determine if the door latch is in a locked or unlocked position. The occupancy indicator 10 may comprise different colors, which may identify different modes of the door lock. The prominence of the occupancy indicator 10 may vary depending on the size of the door lock, the use of the lock etc. Thus, the occupancy indicator 10 may be relatively discreet (e.g. a circle having a diameter of between 2-5 millimeters) or more prominent.

The visual indicator 16 is described herein in one embodiment as comprising a light, such as an LED. It is preferred that the LED is of the type that can emit light of different colors such that a single LED can be used to visually identify different modes of the lock. However, it is also envisaged that the lock may comprise a plurality of lights, each identifying a particular mode. The LED can emit a red/yellow/green color (for example) depending on the mode of the lock.

The door lock 11 may comprise a manual lock which is operated by a key, the latch operator 12, etc. Alternatively, the door lock 11A may comprise an electronic lock which contains the required circuitry to enable at least some of the modes of the lock to be obtained remotely, typically by a remote control. Alternatively, the door lock 11A can be an electronic lock. In this embodiment, a remote control may be used to operate the lock between at least some of the modes. With this mechanism, the door lock 11A may contain a small electric motor to operate the various components between the various modes. The door lock 11A will therefore be electrically powered.

In a method of using a visual lock indicator, any of the visual lock indicators described above may be used. In referring to FIGS. 1A to 1C, the method includes entering the room and closing the door in the direction of arrow X while inside the room. The occupant then operates the lock control to a first position in the direction of arrow Y to activate the door lock, securing the exterior handle in the locked position, the lock control first position further activating the visual lock indicator to indicate that the room is occupied and secured. Upon the occupant wanting to deactivate the visual lock indicator, either to exit the room or to indicate to a passerby that the lock is in the unsecured position, the occupant moves the lock control in the direction of arrow Z to a second position to deactivate the visual lock indicator and to allow movement of the interior door handle to open the door. The directions of arrows Y and Z may be reversed depending upon the configuration of the lock. The lock control may alternately be a push button, lever or other control.

In use, when the occupancy indicator 10 is not illuminated, the door lock 11A, 11B is in an unlocked condition and the room is vacant. Operation of the lock control 17, such as by turning a knob or key, is sufficient to change the position of the actuator 54, allowing the electrical circuit between the power source 30 and the circuit board 74 to be complete. This causes the occupancy indicator 10 to illuminate when the door lock 11 is locked. The occupancy indicator 10 continues to be illuminated as the long as the door lock 11 is in the locked condition providing a visual indication that the associated room is occupied.

In any of the embodiments described above, the occupancy indicator may be an audio producing device or other device which may alert a passerby that the room is occupied.

The bored lock occupancy indicator 2 has many advantages, including when, for safety reasons, the inside operator must always be free to open the door for immediate exit, whether the outside operator is locked or unlocked. The occupancy indicator 10, if in the interior handle 12', allows the room occupants to insure that the door is locked, preventing unwanted intruders from entering the secured space.

Thus, the present invention provides a visual indication of a door being locked and an illuminated indicator on the outside of a door being locked. The present invention also provides a bored lock which includes two states that may alert a person from a distance that a room is occupied. The present invention also provides an illuminated indicator on the inside of a door being locked.

Thus, having described the invention, what is claimed is:

1. A bored lock for a door to a room comprising:

an interior handle disposed on an interior surface of the door the interior handle having a lock control, the lock control operable between a first position and a second position;

an exterior handle disposed on an exterior surface of the door;

a visual lock indicator on a portion of the interior or exterior handle;

a lock body including a cylindrical lock barrel having a cavity therein for the placement of a power source, the lock body disposed between the interior handle and the exterior handle, the lock body operable by the lock control from the first position wherein the exterior handle allows the door to open to the second position wherein the exterior door handle is prevented from opening the door;

wherein the visual lock indicator is in an off condition when the lock control is in the first position and the visual lock indicator is in an on condition powered by the power source when the lock control in the second position, the visual lock indicator indicating that the room is occupied and secured.

2. The lock of claim 1 wherein the exterior handle includes a recess or a projection for unlocking the door lock.

3. The lock of claim 1 wherein the visual lock indicator is disposed on the exterior handle.

4. The lock of claim 1 wherein the visual lock indicator is disposed on the interior handle.

5. The lock of claim 1 wherein the visual lock indicator comprises:

a power source disposed in the lock barrel cavity, the power source for providing electrical power to the visual lock indicator; and an actuator disposed between the power source and the visual lock indicator, the actuator in communication with the lock control;

wherein the lock control in the first position places the actuator in the first actuator position, preventing electrical current from flowing from the power source to the visual lock indicator and the lock control in the second position places the actuator in the second actuator position prevents electrical current from flowing from the power source to the visual lock indicator.

6. The visual lock indicator of claim 5 wherein the lock barrel is conductive and includes a cavity in an interior portion thereof and a protrusion inside the cavity extending inwardly from the lock barrel, wherein the actuator provides an electrical connection to the lock barrel protrusion when the lock control is in the second position.

7. The visual lock indicator of claim 1 wherein the visual lock indicator is in communication with an electronic device for monitoring the visual lock indicator.

8. The visual lock indicator of claim 1 wherein the lock control is in communication with an electronic device for controlling the lock control.

9. The lock as claimed in claim 1, wherein the visual lock indicator is viewable through an opening in the interior handle or the exterior handle.

10. The lock as claimed in claim 1, wherein the visual lock indicator provides different colors, different numbers, different letters, and/or different shapes to indicate occupancy of a room.

11. The lock as claimed in claim 1, wherein the visual lock indicator comprises a light.

12. The lock as claimed in claim 11, wherein the light is a LED.

13. The lock as claimed in claim 1, wherein the visual lock indicator is operated by a key operated mechanism.

14. The lock of claim 1 wherein the visual lock indicator is disposed in a cap on the exterior handle and further includes:

an electrically conductive lock barrel having a cylindrical body, a cavity in an interior portion of the cylindrical body and a protrusion inside the cavity extending inwardly from the cylindrical body;

a circuit board having an occupancy indicator, the circuit board disposed at a first end of the lock barrel and including a first and second power input terminal, the occupancy indictor providing a visual signal when power is applied to the first and second circuit board terminal;

a power source disposed in the lock barrel cavity, the power source having a first and second terminal for providing electrical power to the circuit board, the power source second terminal in electrical communication with the circuit board second terminal;

an insulator disposed at a second end of the lock barrel opposite the first end, the insulator having a flat inside surface and an outside surface including at least one tab extending therefrom;

an actuator disposed against the inside surface of the insulator, the actuator in communication with a first terminal of the power source and moveable from a first position allowing electrical current to flow from the first terminal of the power source to the conductive lock barrel to a second position which prevents electrical current from flowing from the first terminal of the power source to the conductive lock barrel; and a lock tail secured to the at least one tab of the insulator, the lock tail extending outwardly from the insulator in a direction opposite the first end of the lock barrel, the lock tail extending from the outer lock opening to the inner lock opening in communication with the lock control;

wherein the lock control in the locked position places the actuator in the first actuator position allowing electrical current to flow from the first terminal of the power source through the lock barrel and to the first terminal of the circuit board and the lock control in the unlocked position places the actuator in the second actuator position preventing electrical current from flowing though the lock barrel and into the first terminal of the circuit board.

15. A bored lock for a door comprising:

an inner door handle including an inner lock opening extending to a door latch;

an outer door handle including an outer lock opening extending to the inner lock opening;

a lock control disposed in the inner lock opening, the lock control movable from a locked position wherein the door latch is prevented from being moved by the outer door handle to an unlocked position wherein then door latch may be retracted by movement of the outer door handle;

a visual lock indicator disposed in the inner or outer lock opening, the visual lock indicator in communication with the locking control and comprising:

an electrically conductive lock barrel having a cylindrical body, a cavity in an interior portion of the cylindrical body and a protrusion inside the cavity extending inwardly from the cylindrical body;

a circuit board having an occupancy indicator disposed in a cap on the outer door handle, the circuit board disposed at a first end of the lock barrel and including a first and second power input terminal, the occupancy indicator providing a visual signal when power is applied to the first and second circuit board terminal;

a power source disposed in the lock barrel cavity, the power source having a first and second terminal for providing electrical power to the circuit board, the power source second terminal in electrical communication with the circuit board second terminal;

an insulator disposed at a second end of the lock barrel opposite the first end, the insulator having a flat inside surface and an outside surface including at least one tab extending therefrom;

an actuator disposed against the inside surface of the insulator, the actuator in communication with a first terminal of the power source and moveable from a first position allowing electrical current to flow from the first terminal of the power source to the conductive lock barrel to a second position which prevents electrical current from flowing from the first terminal of the power source to the conductive lock barrel; and a lock tail secured to the at least one tab of the insulator, the lock tail extending outwardly from the insulator in a direction opposite the first end of the lock barrel, the lock tail extending from the outer lock opening to the inner lock opening in communication with the lock control;

wherein the lock control in the locked position places the actuator in the first actuator position allowing electrical current to flow from the first terminal of the power source through the lock barrel and to the first terminal of the circuit board and the lock control in the unlocked position places the actuator in the second actuator position preventing electrical current from flowing though the lock barrel and into the first terminal of the circuit board.

16. A visual lock indicator comprising:

an electrically conductive cylindrical lock barrel having a cavity;

a circuit board having an occupancy indicator disposed in a cap, the circuit board disposed at a first end of the lock barrel and including a first and second power input terminal, the occupancy indicator providing a visual signal when power is applied to the first and second circuit board terminal;

a power source disposed in the lock barrel cavity, the power source having a first and second terminal for providing electrical power to the circuit board, the power source second terminal in electrical communication with the circuit board second terminal;

an insulator disposed at a second end of the lock barrel opposite the first end, the insulator having a flat inside surface and an outside surface including at least one tab extending therefrom;

an actuator disposed against the inside surface of the insulator wherein in a first position the actuator provides an electrical connection from the power source to the circuit board and in a second position the actuator prevents electrical current from flowing from the power source to the circuit board;

a lock tail secured to the at least one tab of the insulator, the lock tail extending outwardly from the insulator in a direction opposite the first end of the lock barrel, the lock tail extending from the outer lock opening to the inner lock opening in communication with the lock actuator; and wherein the lock actuator in the locked position places the actuator in the first actuator position allowing electrical current to flow from the first terminal of the power source through the lock barrel and to the first terminal of the circuit board and the lock actuator in the unlocked position places the actuator in the second actuator position preventing electrical current from flowing though the lock barrel and into the first terminal of the circuit board;

wherein the visual lock indicator is disposable in a lock opening, and is operated by a lock control to indicate that the lock is secured.

17. A method of using a visual lock indicator comprising:

providing a bored door lock disposed on a door to a room, the bored door lock having an interior handle, an exterior handle, a lock control on a portion of the interior door handle, a power source disposed in the bored door lock and the visual lock indicator on a portion of the interior or exterior door portion;

entering the room;

closing the door while inside the room;

operating the lock control to a first position to activate the door lock, securing the exterior handle in the locked position, the lock control first position further activating the visual lock indicator to indicate that the room is occupied and secured; and upon desire to deactivate the visual lock indicator, operating the lock control to a second position to deactivate the visual lock indicator and allow movement of the interior door handle to open the door.

18. The method of claim 17 wherein the visual lock indicator comprises:

an electrically conductive lock barrel having a cylindrical body, a cavity in an interior portion of the cylindrical body and a protrusion inside the cavity extending inwardly from the cylindrical body;

a circuit board having an occupancy indicator disposed in a cap, the circuit board disposed at a first end of the lock barrel and including a first and second power input terminal, the occupancy indicator providing a visual signal when power is applied to the first and second circuit board terminal;

a power source disposed in the lock barrel cavity, the power to the circuit board, the power source second terminal in electrical communication with the circuit board second terminal;

an insulator disposed at a second end of the lock barrel opposite the first end, the insulator having a flat inside surface and an outside surface including at least one tab extending therefrom;

an actuator disposed against the inside surface of the insulator, the actuator in communication with a first terminal of the power source and moveable from a first position allowing electrical current to flow from the first terminal of the power source to the conductive lock barrel to a second position which prevents electrical current from flowing from the first terminal of the power source to the conductive lock barrel; and a lock tail secured to the at least one tab of the insulator, the lock tail extending outwardly from the insulator in a direction opposite the first end of the lock barrel, the lock tail extending from the outer lock opening to the inner lock opening in communication with the lock control;

wherein the lock control in the locked position places the actuator in the first actuator position allowing electrical current to flow from the first terminal of the power source through the lock barrel and to the first terminal of the circuit board and the lock control in the unlocked position places the actuator in the second actuator position preventing electrical current from flowing though the lock barrel and into the first terminal of the circuit board.

19. The method of claim 17 wherein the visual lock indicator is on the interior handle.

20. The method of claim 17 wherein the visual lock indicator is on the exterior handle.

* * * * *